US008511239B2

(12) United States Patent
Lin

(10) Patent No.: US 8,511,239 B2
(45) Date of Patent: Aug. 20, 2013

(54) REINFORCED PLASTIC PALLET

(75) Inventor: I-Wen Lin, Tainan (TW)

(73) Assignee: King & Stress Industrial Co., Ltd. (TW)

( * ) Notice: Subject to any disclaimer, the term of this patent is extended or adjusted under 35 U.S.C. 154(b) by 170 days.

(21) Appl. No.: 13/240,586

(22) Filed: Sep. 22, 2011

(65) Prior Publication Data

US 2012/0291677 A1 Nov. 22, 2012

(30) Foreign Application Priority Data

May 18, 2011 (TW) ..... 100208880

(51) Int. Cl.
*B65D 19/32* (2006.01)

(52) U.S. Cl.
USPC ..... 108/57.25; 108/901; 108/53.1

(58) Field of Classification Search
USPC ..... 108/901, 51.11, 53.1, 53.3, 57.25, 108/57.27, 57.28, 59.29; 206/386, 599
See application file for complete search history.

(56) References Cited

U.S. PATENT DOCUMENTS

| | | | | | |
|---|---|---|---|---|---|
| 3,404,642 | A * | 10/1968 | Belcher et al. | ..... | 108/57.1 |
| 3,561,375 | A * | 2/1971 | Hammond et al. | ..... | 108/53.1 |
| 5,205,221 | A * | 4/1993 | Melin et al. | ..... | 108/51.3 |
| 5,606,921 | A * | 3/1997 | Elder et al. | ..... | 108/53.3 |
| D548,924 | S * | 8/2007 | Frankenberg | ..... | D34/38 |
| 7,607,628 | B2 * | 10/2009 | Elder et al. | ..... | 248/346.02 |
| 8,291,839 | B2 * | 10/2012 | Apps et al. | ..... | 108/57.25 |
| 2005/0199623 | A1 * | 9/2005 | Elder et al. | ..... | 220/4.28 |
| 2010/0154685 | A1 * | 6/2010 | Arinstein | ..... | 108/57.16 |
| 2010/0326334 | A1 * | 12/2010 | Lin | ..... | 108/53.1 |

* cited by examiner

*Primary Examiner* — Janet M Wilkens
(74) *Attorney, Agent, or Firm* — Banner & Witcoff, Ltd.

(57) ABSTRACT

A reinforced plastic pallet includes a modular platform having top and bottom major walls which respectively have left and right stacked and held segments confronting each other. The stacked and held segments respectively have depression and supported regions. A spacer extends downwardly from each of the supported regions to have a base region confronting the corresponding depression region. A hollow strut extends upwardly from the base region through the corresponding depression region, and has an open end joining with the corresponding depression region. With the hollow struts, the structural strength of the spacers can be increased so as to prevent deformation thereof when the plastic pallet is subjected to a heavy load.

8 Claims, 7 Drawing Sheets

REINFORCED PLASTIC PALLET

CROSS-REFERENCE TO RELATED APPLICATION

This application claims priority of Taiwanese Patent Application No. 100208880, filed on May 18, 2011, the disclosure of which is herein incorporated by reference.

BACKGROUND OF THE INVENTION

1. Field of the Invention

This invention relates to a plastic pallet, more particularly to a reinforced plastic pallet.

2. Description of the Related Art

Referring to FIG. 1, a conventional plastic pallet is shown to include a load-supporting platform 100 and a plurality of support legs 200 extending downwardly from a lower surface of the platform 100. Since the support legs 200 are in the form of a hollow block and are spaced apart from one another, they lack sufficient structural strength, and would deform when loaded with heavy goods. The platform is therefore liable to deform and sag.

SUMMARY OF THE INVENTION

An object of the present invention is to provide a reinforced plastic pallet which has a reliable structural strength to prolong the service life.

According to this invention, the reinforced plastic pallet includes a modular platform including top and bottom major walls spaced apart from each other by a major space. The top major wall has top left and right ends opposite to each other in a transverse direction, and left and right stacked segments adjacent to the top left and right ends, respectively. Each of the left and right stacked segments has a plurality of depression regions displaced from each other in a longitudinal direction. The bottom major wall has bottom left and right ends joining the top left and right ends, respectively, and left and right held segments, each having a plurality of supported regions that are displaced from each other in the longitudinal direction to confront respectively the depression regions. A hollow left spacer unit includes a plurality of left spacers extending respectively and downwardly from the supported regions of the left held segment. Each of the left spacers has a left base region which is in spatial communication with the major space and which confronts the corresponding depression region. A hollow right spacer unit includes a plurality of right spacers extending respectively and downwardly from the supported regions of the right held segment. Each of the right spacers has a right base region which is in spatial communication with the major space and which confronts the corresponding depression region. A plurality of left hollow struts each extends upwardly from the left base region through the corresponding depression region, and has a left open end joining with the corresponding depression region. A plurality of right hollow struts each extends upwardly from the right base region through the corresponding depression region, and has a right open end joining with the corresponding depression region. With the hollow struts, the structural strength of the left and right spacer units can be increased so as to prevent deformation thereof when the plastic pallet is subjected to a heavy load.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
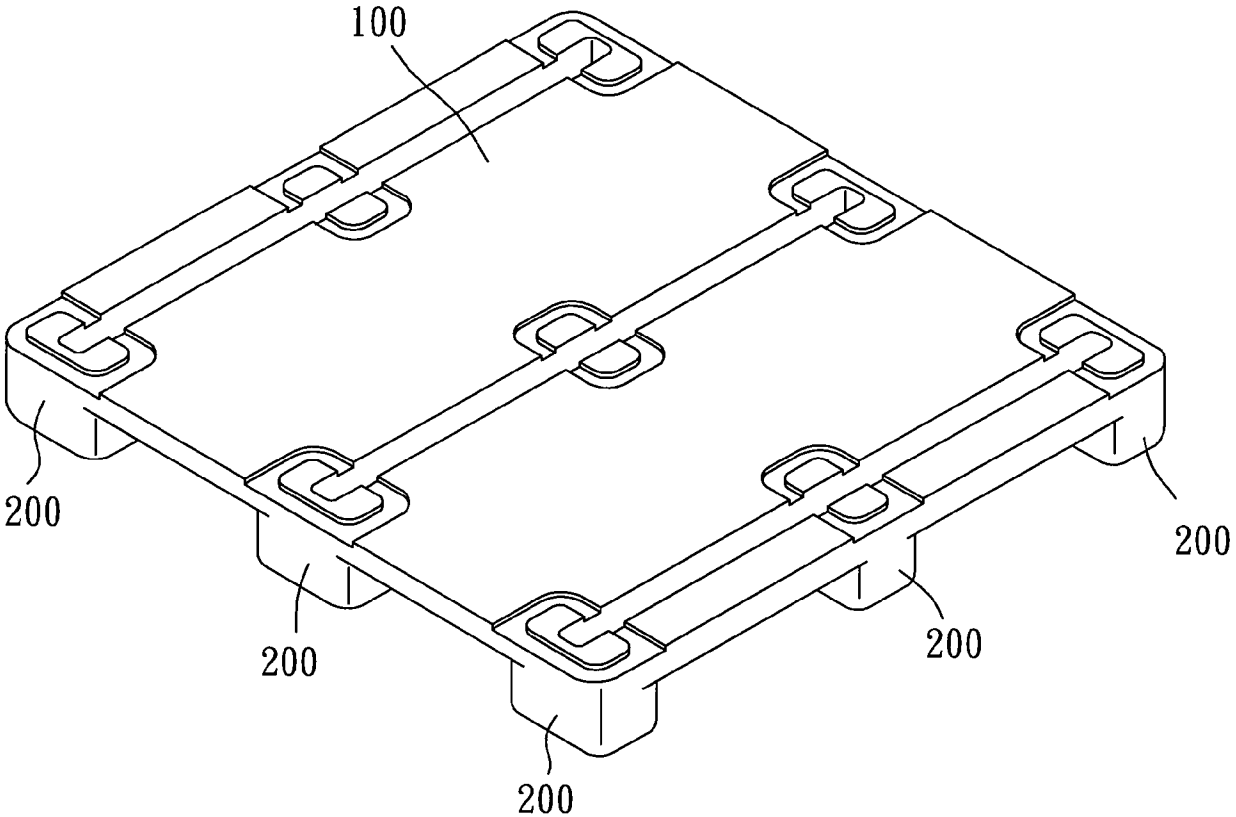
FIG. 1 PRIOR ART
FIG. 1 is a perspective view of a conventional plastic pallet.

Referring to FIGS. 2 to 5, the embodiment of a reinforced plastic pallet according to the present invention is shown to comprise a modular platform 10 which includes a top major wall 3 and a bottom major wall 2, hollow left and right spacer units 4 which respectively includes a plurality of left and right spacers 41, a plurality of left, right, and middle hollow struts 5, a plurality of bordering hollow struts 8, and a plurality of auxiliary hollow struts 9.

Figure 2:
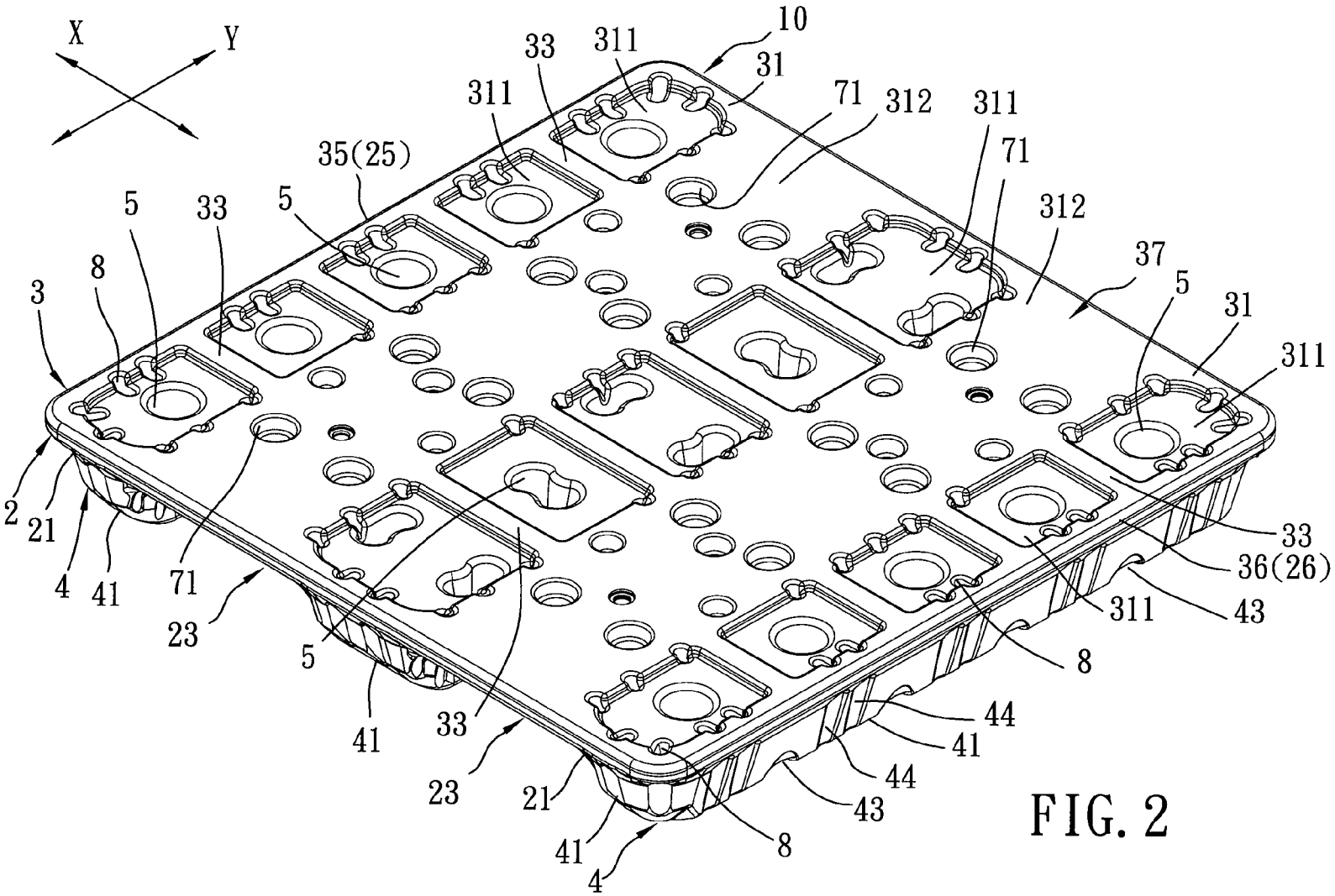
FIG. 2 is a perspective view of the embodiment of a reinforced plastic pallet according to this invention.
Figure 3:
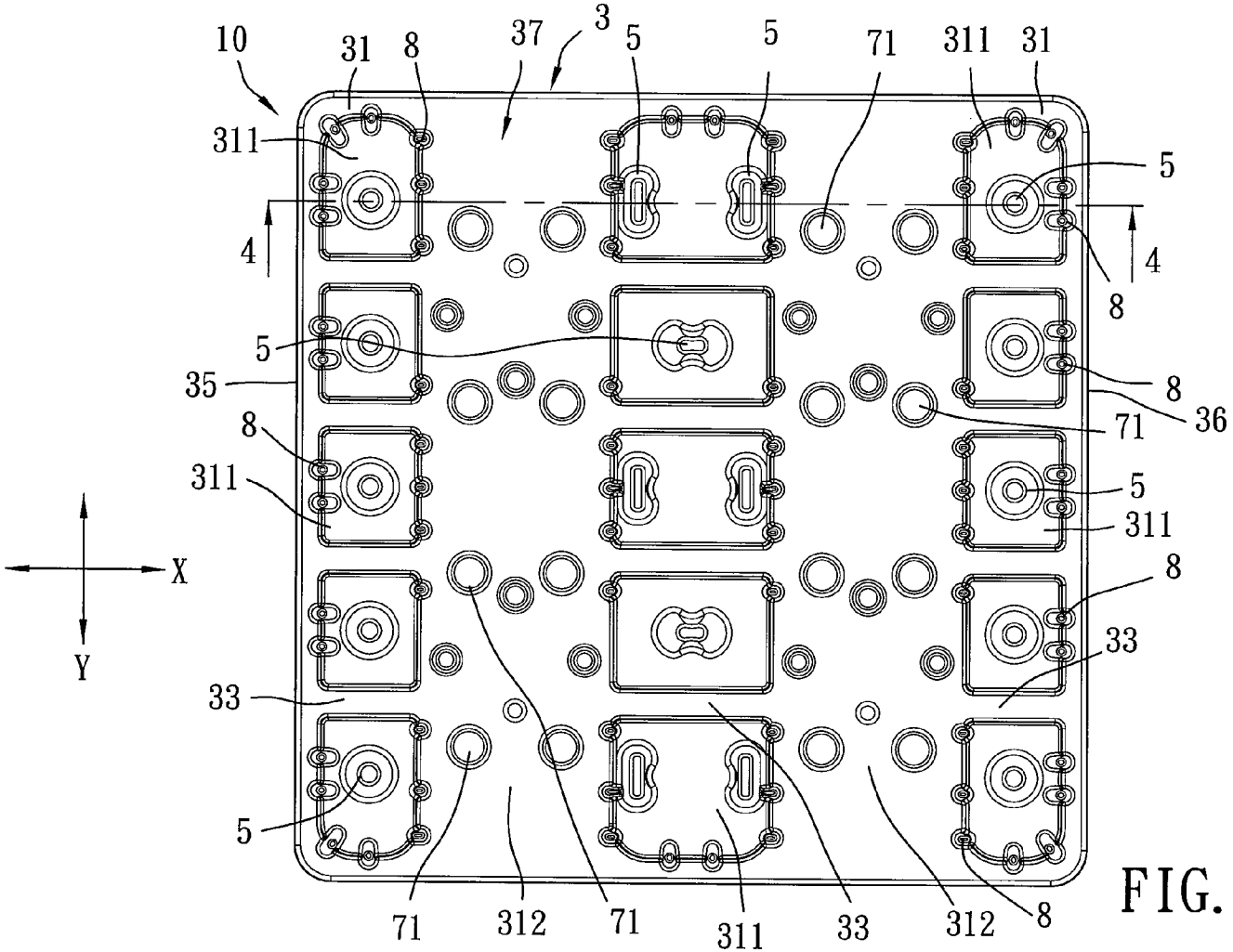
FIG. 3 is a top view of the embodiment.

Referring to FIGS. 2 and 3, the top major wall 3 has top left and right ends 35, 36 opposite to each other in a transverse direction (X), and left and right stacked segments 31 adjacent to the top left and right ends 35, 36, respectively. Each of the left and right stacked segments 31 has a plurality of depression regions 311 which are displaced from each other in a longitudinal direction (Y), and a plurality of convexity regions 33 each disposed between two adjacent ones of the depression regions 311. A middle portion 37 of the top major wall 3 may have a plurality of depression regions 311 and convexity regions 33 alternately arranged in the longitudinal direction, and left and right load segments 312 flanking the depression regions 311 and the convexity regions 33.

Figure 4:
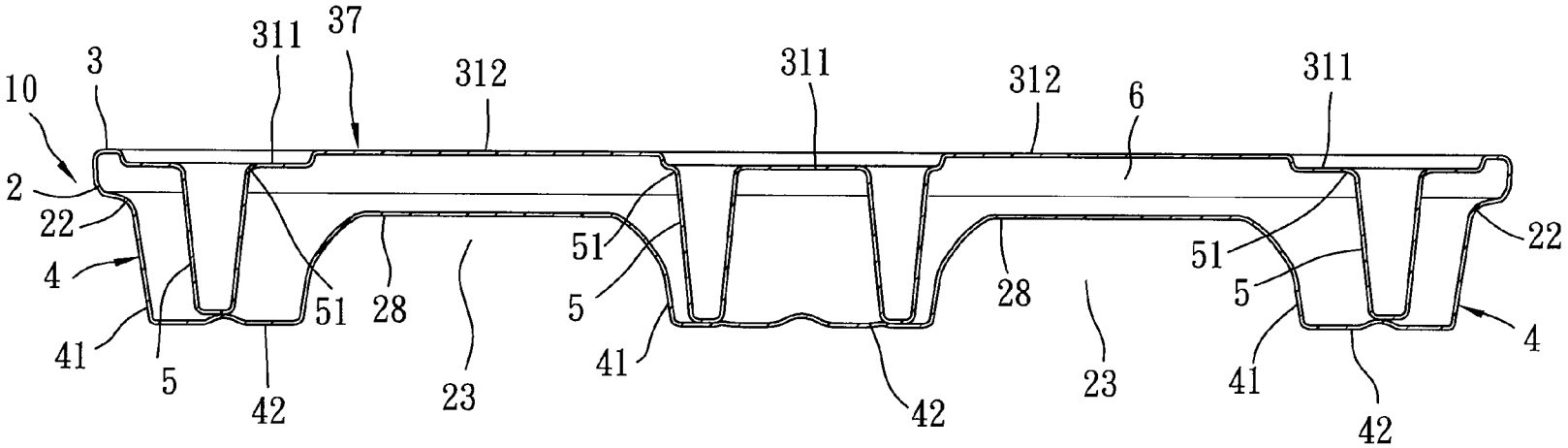
FIG. 4 is a sectional view taken along line 4-4 of FIG. 3.
Figure 5:
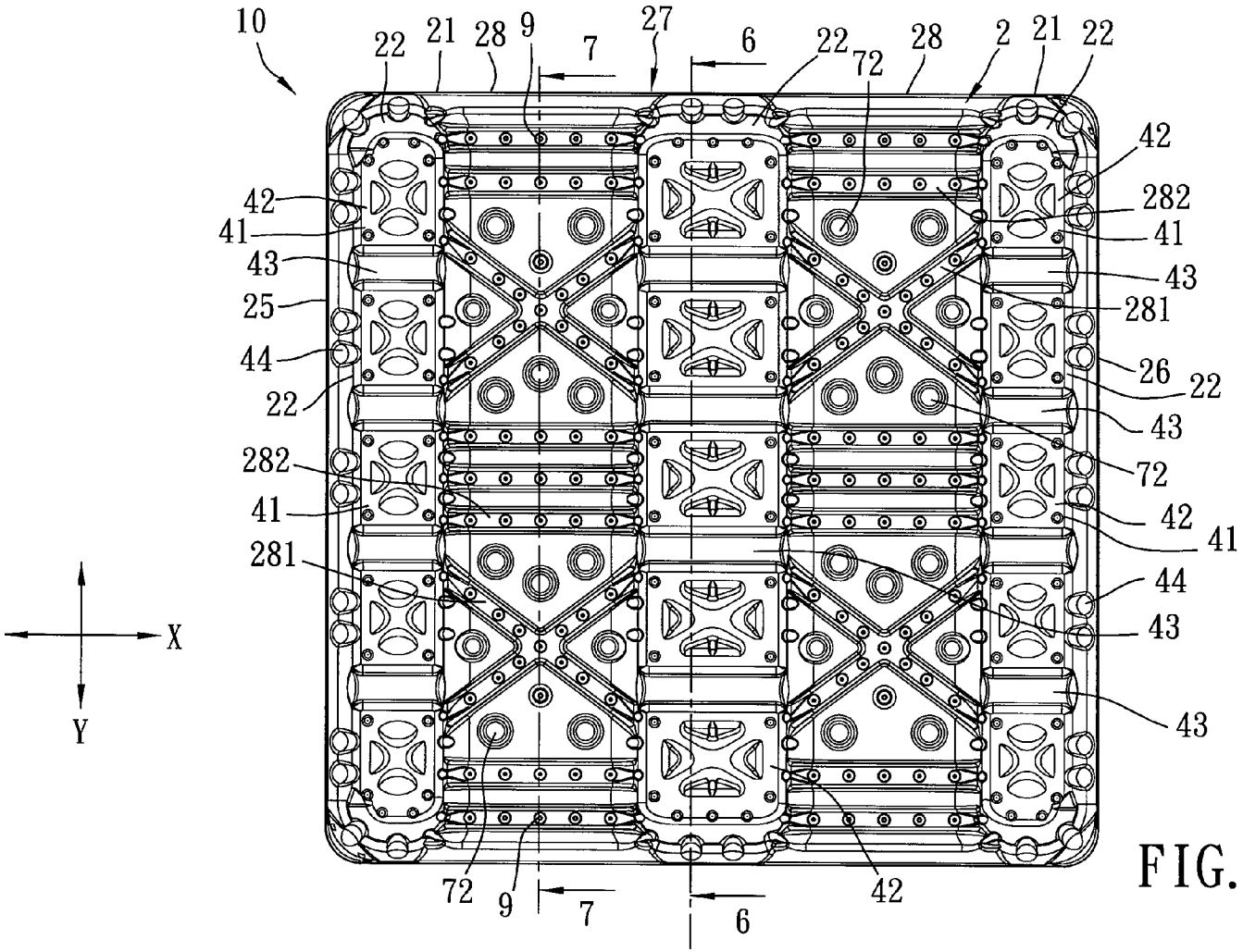
FIG. 5 is a bottom view of the embodiment.

Referring to FIGS. 2, 4 and 5, the bottom major wall 2 is spaced apart from the top major wall 3 in an upright direction by a major space 6, and has bottom left and right ends 25, 26 joining the top left and right ends 35, 36, respectively, and left and right held segments 21, each of which has a plurality of supported regions 22 that are displaced from each other in the longitudinal direction (Y), and that respectively confront the depression regions 311 of a respective one of the left and right stacked segments 31 in the upright direction.

Figure 6:
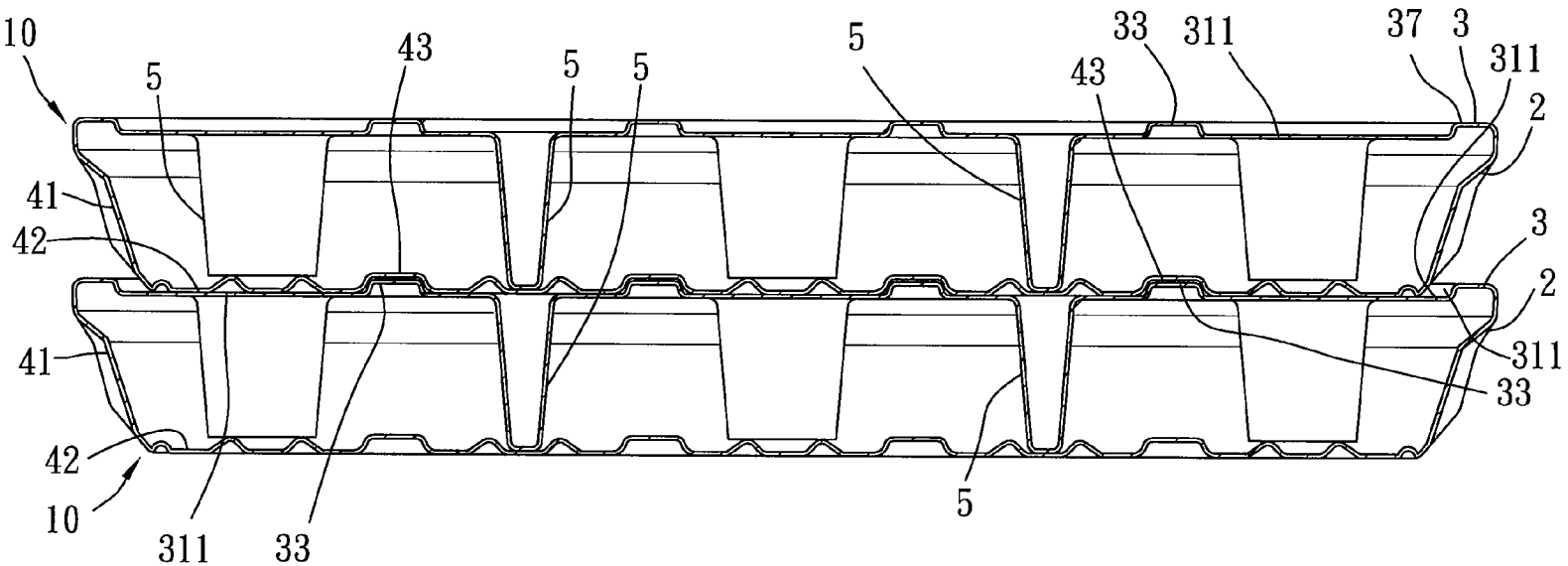
FIG. 6 is a sectional view taken along line 6-6 of FIG. 5, showing two pallets according to the embodiment are stacked.

Each of the left and right spacers 41 extends downwardly from a respective one of the supported regions 22 and has a base region 42 in spatial communication with the major space 6 and confronting the corresponding depression region 311. Each of the left and right spacer units 4 further has a plurality of concavity regions 43 each disposed between two adjacent ones of the base regions 42. As shown in FIG. 6, each of the concavity regions 43 is configured to mate with a corresponding one of the convexity regions 33 so as to provide a positive engagement between the reinforced plastic pallets when stacked on each other. Moreover, a plurality of side struts 44 are formed in each of the left and right spacers 41 to increase the structural strength thereof.

In this embodiment, a middle portion 27 of the bottom major wall 2 may have a plurality of supported regions 22, and a plurality of middle spacers 41 may be configured to extend downwardly from the supported regions 22 and have base and concavity regions 42, 43 alternately arranged in the longitudinal direction (Y). The middle portion 27 further has left and right elevated segments 28 disposed adjacent to the left and right held segments 21, respectively, and confronting and spaced apart from the left and right load segments 312, respectively, by the major space 6. The left and right elevated segments 28 respectively cooperate with the left and right spacer units 4 to define left and right fork insertion spaces 23, respectively.

Figure 7:
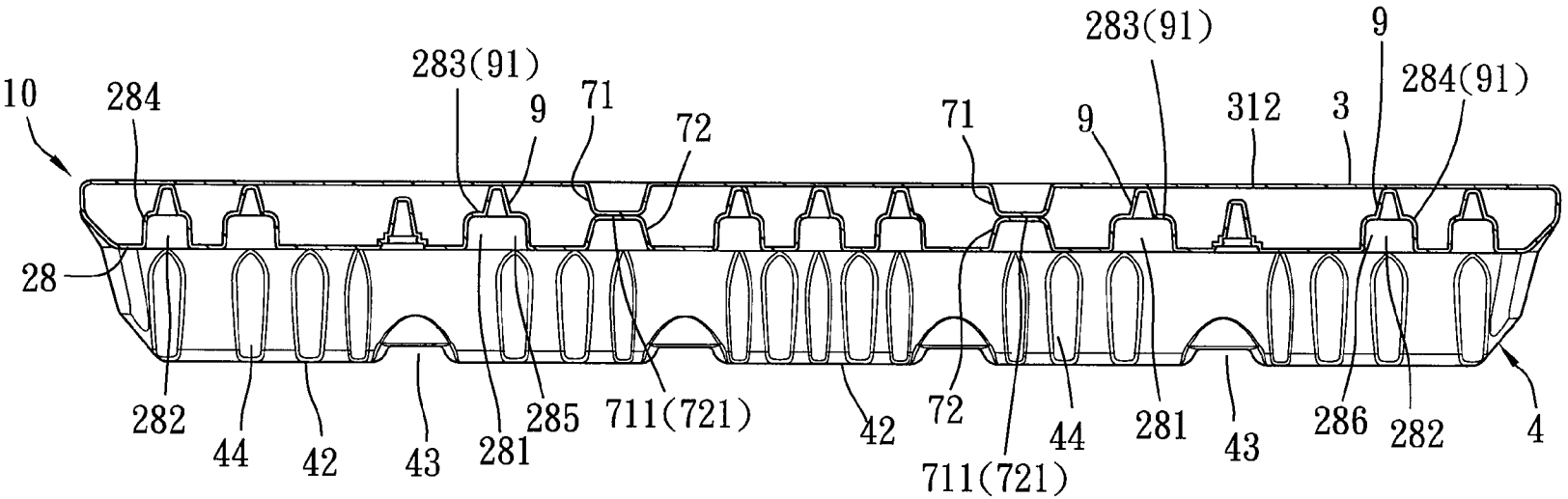
FIG. 7 is a sectional view taken along line 7-7 of FIG. 5.

Additionally, referring to FIGS. 5 and 7, a plurality of hollow crossbeams 281, 282 extend upwardly from one of the left and right elevated segments 28 to terminate at elongated abutment walls 283, 284. Each of the hollow crossbeams 281, 282 defines a groove space 285, 286. The hollow crossbeams 281, 282 may be crisscross and parallel in shape.

Referring to FIGS. 2 to 4, each of the left, right, and middle hollow struts 5 extends upwardly from a respective one of the base regions 42 through a corresponding one of the depression regions 311, and has an open end 51 joining with the corresponding depression region 311. Each of the left and right hollow struts 5 is of a circular shape, and each middle hollow strut 5 is of an oval shape. With the left, right and middle hollow struts 5, the structure between each of the depression regions 311 and the corresponding spacer 41 can be strengthened so as to prevent deformation of the spacers 41 to thereby support a heavy load on the platform 10.

Further, referring to FIGS. 2, 3, 5 and 7, a plurality of upper hollow strut halves 71 are disposed on the middle portion 37 of the top major wall 3, and a plurality of lower hollow strut halves 72 are disposed on the middle portion 27 of the bottom major wall 2. Each upper hollow strut half 71 extends downwardly from one of the left and right load segments 312 to terminate at an upper abutment 711. Each lower hollow strut half 72 extends upwardly from one of the left and right elevated segments 28 to terminate at a lower abutment 721 which is in abutting engagement with the upper abutment 711 of the corresponding upper hollow strut half 71. Each of the upper and lower hollow strut halves 71, 72 may have the same or different configuration.

Further, referring to FIGS. 2 and 3, each of the bordering hollow struts 8 is disposed between two adjacent ones of the depression regions 311 and the corresponding load segment 312 so as to reinforce structure of a periphery of the corresponding depression regions 311.

Further, referring to FIGS. 5 and 7, each of the auxiliary hollow struts 9 extends downwardly from one of the left and right load segments 312 and has a lower open end 91 extending through the elongated abutment wall 283, 284 of a corresponding one of the hollow crossbeams 281, 282 so as to be in spatial communication with the groove space 285, 286 and to join with a corresponding one of the left and right elevated segments 28. Each of the auxiliary hollow struts 9 is configured to be divergent downwardly to the lower open end 91.

Since the elongated left and right spacer units 4 which have a relatively large area contact with the ground surface can bear evenly against a heavy load that is supported by the platform 10, deformation and inclination of the left and right spacer units 4 can be prevented. By virtue of the hollow struts 5, 9, the strut halves 71, 72, and the hollow crossbeams 281, 282, the structural strength of the reinforced plastic pallet can be increased. Moreover, when a plurality of plastic pallets are stacked, the base regions 42 of the spacers 41 of an upper plastic pallet are received respectively in the depression regions 311 of the top major wall 3 of a lower plastic pallet, and the concavity regions 43 of the upper plastic pallet are engaged respectively with the convexity regions 33 of the lower plastic pallet. Hence, the plastic pallets can be stacked firmly in the upper direction.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. An reinforced plastic pallet comprising:

a modular platform including a top major wall which has top left and right ends opposite to each other in a transverse direction, and left and right stacked segments adjacent to said top left and right ends, respectively, each of said left and right stacked segments having a plurality of depression regions which are displaced from each other in a longitudinal direction, and a bottom major wall which is spaced apart from said top major wall in an upright direction by a major space, and which has bottom left and right ends joining said top left and right ends, respectively, and left and right held segments, each of which has a plurality of supported regions that are displaced from each other in the longitudinal direction, and that respectively confront said depression regions of a respective one of said left and right stacked segments in the upright direction;

a hollow left spacer unit which includes a plurality of left spacers that extend respectively and downwardly from said supported regions of said left held segment, each of said left spacers having a left base region which is in spatial communication with said major space and which confronts a corresponding one of said depression regions;

a hollow right spacer unit which includes a plurality of right spacers that extend respectively and downwardly from said supported regions of said right held segment, each of said right spacers having a right base region which is in spatial communication with said major space and which confronts a corresponding one of said depression regions;

a plurality of left hollow struts, each extending upwardly from said left base region through a corresponding one of said depression regions, and having a left open end joining with the corresponding one of said depression regions; and a plurality of right hollow struts, each extending upwardly from said right base region through a corresponding one of said depression regions, and having a right open end joining with the corresponding one of said depression regions.

2. The reinforced plastic pallet as claimed in claim 1, wherein each of said left and right stacked segments has a plurality of convexity regions each disposed between two adjacent ones of said depression regions, each of said left and right spacer units having a plurality of concavity regions each of which is disposed between two adjacent ones of said base regions and which is configured to mate with a corresponding one of said convexity regions so as to provide a positive engagement between said reinforced plastic pallets when stacked on each other.

3. The reinforced plastic pallet as claimed in claim 2, wherein said bottom major wall has left and right elevated segments which are disposed adjacent to said left and right held segments, respectively, and which cooperate with said hollow left and right spacer units to define left and right fork insertion spaces, respectively;

said top major wall having left and right load segments which respectively confront and are spaced apart from said left and right elevated segments by said major space.

4. The reinforced plastic pallet as claimed in claim 3, further comprising a plurality of upper hollow strut halves each extending downwardly from one of said left and right load segments to terminate at an upper abutment; and a plurality of lower hollow strut halves each extending upwardly from one of said left and right elevated segments to terminate at a lower abutment which is in abutting engagement with said upper abutment of a corresponding one of said upper hollow strut halves.

5. The reinforced plastic pallet as claimed in claim 3, further comprising a plurality of bordering hollow struts, each disposed between two adjacent ones of said depression regions and said load segments so as to reinforce structure of a periphery of a corresponding one of said depression regions.

6. The reinforced plastic pallet as claimed in claim 3, further comprising a plurality of auxiliary hollow struts, each extending downwardly from one of said left and right load segments and having a lower open end for joining with a corresponding one of said left and right elevated segments.

7. The reinforced plastic pallet as claimed in claim 6, wherein each of said auxiliary hollow struts is configured to be divergent downwardly to said lower open end.

8. The reinforced plastic pallet as claimed in claim 7, further comprising a plurality of hollow crossbeams each defining a groove space, and each extending upwardly from one of left and right elevated segments to terminate at an elongated abutment wall, said lower open end of each of said auxiliary hollow struts extending through said elongated abutment wall of a corresponding one of said hollow crossbeams so as to be in spatial communication with said groove space.

* * * * *